US006092913A

United States Patent [19]

Edwards, Jr.

[11] Patent Number: 6,092,913

[45] Date of Patent: Jul. 25, 2000

[54] FLUORESCENT LIGHT FIXTURE

[75] Inventor: Richard D. Edwards, Jr., Warwick, R.I.

[73] Assignee: RENOVA Technologies, LLC, Smithfield, R.I.

[21] Appl. No.: 09/048,554

[22] Filed: Mar. 26, 1998

[51] Int. Cl.[7] ..... F21K 27/00

[52] U.S. Cl. ..... 362/260; 362/147; 362/346

[58] Field of Search ..... 362/147, 148, 362/346, 347, 225, 260

[56] References Cited

U.S. PATENT DOCUMENTS

| | | | |
|---|---|---|---|
| 3,748,460 | 7/1973 | Price | 362/347 |
| 4,344,111 | 8/1982 | Ruud | 362/147 |
| 4,794,317 | 12/1988 | Brass | 362/346 |
| 5,394,317 | 2/1995 | Grenga | 362/347 |

FOREIGN PATENT DOCUMENTS

| | | | |
|---|---|---|---|
| 0140690 | 5/1985 | European Pat. Off. | 362/347 |

*Primary Examiner*—Sandra O'Shea
*Assistant Examiner*—Hargobind S. Sawhney
*Attorney, Agent, or Firm*—William A. Loginov; Cesari and McKenna, LLP

[57] ABSTRACT

A fluorescent fixture having high efficiency and a low profile is provided. The fixture includes a housing having a central well with a pair of tubular fluorescent bulbs mounted therein and extending in a lengthwise direction. Each bulb is surrounded by a double-trough specular reflector with a local peak that extends from the base of the well, toward the bulb. The local peak is positioned generally along a centerline through the bulb. A pair of maximum trough bottoms are positioned on each of opposing sides of the centerline. The reflector configuration reflects a substantial amount of incident light away from the bulb surface and out from the fixture opening where it is needed. The housing includes a pair of sloped outer sides that extend in a widthwise direction away from the reflector outwardly to opposing widthwise edges of the housing to enable light reflected from the reflector to be transmitted toward the widthwise edges of the housing free of obstruction thereto. The fluorescent bulbs can be mounted on brackets that move in a widthwise direction and the reflector is attached to the brackets to flexibly move in response to widthwise movement of the brackets.

7 Claims, 5 Drawing Sheets

FLUORESCENT LIGHT FIXTURE

FIELD OF THE INVENTION

This invention relates to light fixtures and more particularly to a high efficiency fluorescent light fixture.

BACKGROUND OF THE INVENTION

Fluorescent light fixtures that enclose long tubular bulbs are the prevailing form of illumination in industrial and commercial spaces, and are also a popular light fixture in many residential spaces. The shape and configuration of tubular fluorescent bulb fixtures has not changed substantially since their initial introduction. "Flush-mount" fixtures, designed to be inserted into so called "drop ceilings," traditionally define a box-like sheet metal housing having a width of two feet and a length of four feet in the United States. This corresponds to the dimensions of standard one-foot square ceiling tiles. The housing typically holds three or four equally spaced tubular bulbs, each located within its own reflector well. Each reflector well is shaped, generally, like an elongated trough with the bulb seated near the lowest point of the trough. Each end of the bulb is supported in a mounting bracket/connector that also makes electrical contact with a standard two-pin connector on each opposing end of the bulb. A ballast is connected in line between the building 120 VAC current source and the bulbs. The ballast generates a high frequency driving current is located beneath one of more of the reflector wells, or is located on the exterior of the housing The reflector troughs are often metallic, and are painted gloss-white. The opening of the housing faces downwardly to allow light to escape. The rim defining the opening sits flush with the plane of the ceiling, and the opening is either open, or covered with a prismatic diffuser grate formed from translucent plastic.

Similar fluorescent bulb fixtures are used with minor modifications in a so-called "surface-mount" arrangement in which the housing stands out from the ceiling surface, and is fully exposed. In both surface-mount and flush-mount/recessed configurations, the housing is deep and generally bulky. The reflectors tend to absorb a substantial amount of incident light. The arrangement of the bulbs and reflectors also tends to cause light to be transmitted from the bulbs back into the housing. Some light is even reflected back into the bulbs themselves. Many of these three and four-bulb fixtures exhibit a reflected light efficiency of 75% or less. In other words, only 75% of the light generated by each of the bulbs is actually projected out of the opening to where it is needed. 25% or more of the generated light is absorbed by the fixture housing or the bulbs themselves.

Various programs administered by the United States government and public utilities have put forth standards that call for lighting fixtures having higher efficiencies. Accordingly, it is an object of this invention to provide a light fixture that projects light from fluorescent tube bulbs into a space more efficiently and that ensures that a larger proportion of light generated by the tubular bulbs is transmitted to the workspace. It is desirable that this fixture exhibit a less-bulky and/or lower profile that enables mounting on or within ceilings having lower clearances.

SUMMARY OF THE INVENTION

This invention overcomes the disadvantages of the prior art by providing a fluorescent fixture having high efficiency and a low profile. The fixture includes a housing having a central well with a pair of tubular fluorescent bulbs mounted therein and extending in a lengthwise direction. Each bulb is surrounded by a double-trough specular reflector with a local peak that extends from the base of the well, toward the bulb. The local peak is positioned generally along a centerline through the bulb. A pair of maximum trough bottoms are positioned on each of opposing sides of the centerline. The reflector configuration reflects a substantial amount of incident light away from the bulb surface and out from the fixture opening where it is needed.

Since only two bulbs are typically employed, the housing can include outer side walls that taper downwardly toward the outer widthwise edges at a low angle relative to a plane formed in the widthwise direction. The outermost trough side of each reflector is cut-off to enable some light to be transmitted from the bulbs to the outer widthwise edges. The angle enables a low amount of light to extend outwardly to fill the widthwise edges of the fixture. a diffuser grate is positioned over the fixture so that the overall lighting effect appears uniform. This enables a two-bulb fixture to match the appearance of a conventional three or four-bulb fixture.

The reflector can be constructed from a flexible material so that its geometry can be altered. In other words, the reflector can be made more vertical or more horizontal in desired places. In addition, the side walls of the housing can be arranged to include adjustable bulb-mounting brackets, so that the widthwise position of each of the bulbs can be changed. As such, the focus of the light projected from the fixture opening can be adjusted as desired.

The ballast of the fixture can be located in a somewhat-triangular space formed between the central peak of the reflector structure (e.g. the joint between the two bulb double-trough reflectors) and the base of the housing well. The ballast can be located at any other acceptable location on the housing

BRIEF DESCRIPTION OF THE DRAWINGS

The foregoing and other objects and advantages of the invention will become more clear with reference to the following detailed description as illustrated by the drawings in which.

DETAILED DESCRIPTION

Figure 1:
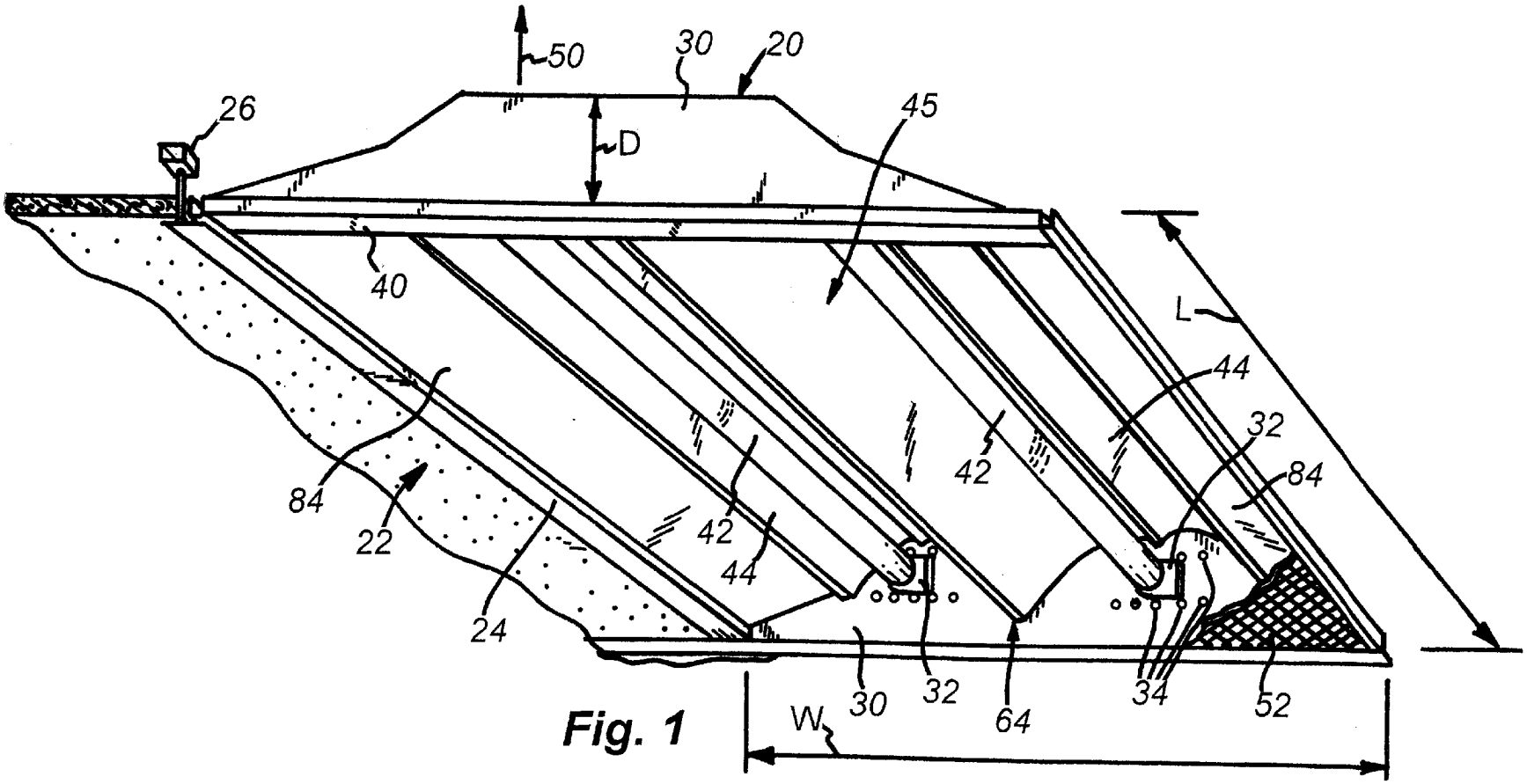
FIG. 1 is a perspective view detailing the interior of a fluorescent light fixture according to this invention.

A fluorescent light fixture according to a preferred embodiment of this invention as detailed in FIG. 1. The light fixture is mounted in a ceiling for purposes of illustration, although any orientation is contemplated. For the purposes of clarity, "down" shall refer to a direction away from the ceiling and toward the floor, while "up" shall be the opposing direction. The light fixture comprises a housing 20 formed from light-gauge sheet steel, plastic or another suitably sturdy material. In this embodiment, the light fixture is a flush-mount style, installed in a drop ceiling 22 using a T-shaped support strip 24 that is anchored using anchoring structures 26 to a portion of the ceiling. The supporting structure for the housing can be conventional in design. It can surround the entire fixture and provide a seamless appearance to the junction of the fixture with the remaining ceiling. The fixture can have any acceptable width W and length L. In this embodiment, the overall width W is two feet and the overall length L is four feet. This is a conventional dimension for fluorescent light fixtures in the United States. It is expressly contemplated that other housing dimensions can be employed. The housing 20 includes a pair of widthwise end walls 30 at each opposing end of the lengthwise dimension. The end walls 30, along their respective interior surfaces, have conventional fluorescent light brackets/two-pin connectors 32 mounted thereon. The brackets 32 are adjustable in the widthwise direction to change the relative spacing of the brackets 32 from each other. Widthwise locations are selected by locating the brackets 32 in each of a plurality of different pairs of mounting holes 34 that are spaced-apart from each other along the width of each side wall 30. The brackets 32 can be located out of direct view due to the presence of an overhang 40 on each end of the fixture. The overhang is approximately two inches. Alternatively, a well can be formed in the side wall 30 beneath the exposed bottom face (the opening) of the housing 20.

Two fluorescent bulbs 42 of conventional design are located in the housing. Centered around each bulb is a respective trough-shaped reflector 44 of an overall reflector structure 45. Each reflector 44 defines a unique shape that is described further below. In general, it is a highly specular (e.g., reflective) surface constructed from thin-gauge steel, aluminum or plastic that is either polished or mirrored. Where appropriate, clear plastic protective coatings can be applied to maintain the specular appearance. It is contemplated that the reflector can be formed from any acceptable material. In cross-section, each reflector 44 defines a well extending from opposing ends in an upward direction (arrow 50). A respective bulb sits near the bottom of each reflector well. An optional translucent panel or grate 52 can be provided over the fixture to conceal the reflectors and bulbs. This grate 52 can include diffuser structure to enhance diffusion of light. The diffuser can comprise a frosted finish, a repeating prismatic pattern (such as a series of pyramids) or any acceptable surface structure. Such a grate is described further below.

Figure 2:
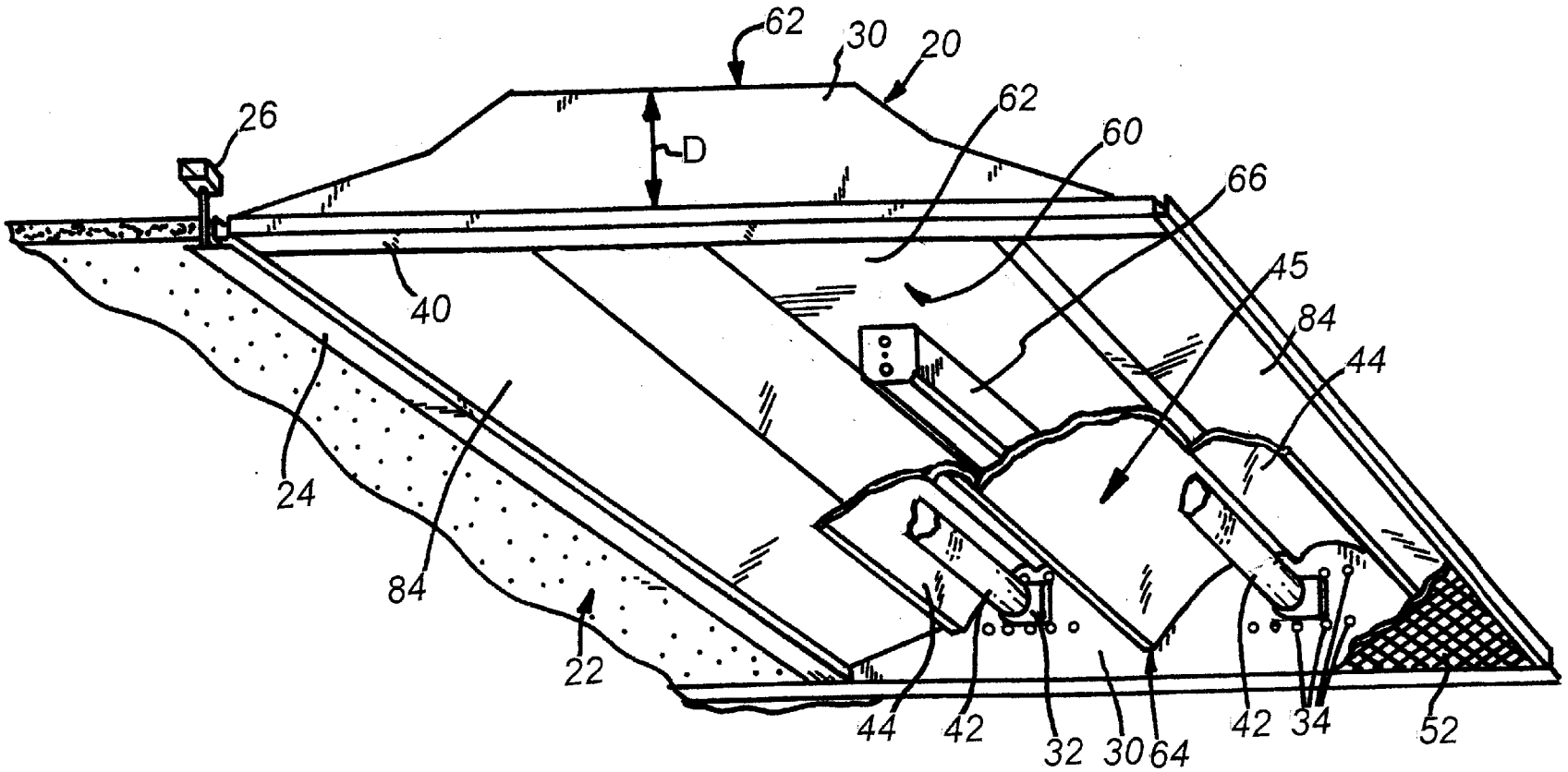
FIG. 2 is a partially exposed perspective view of the light fixture of FIG. 1 detailing the location of the ballast.

With further reference to FIG. 2, the upper, central 60 of the housing 20 is shown in further detail with a portion of the bulbs and reflectors being cut away. The central well 60 has a depth D of approximately 2⅞ inches relative to the opening of the housing. This is the approximate minimum height of the fixture. The reflector 44 associated with each bulb extends away from the base of the well 60 almost the entire depth of the housing. Each reflector meets at a central or main peak 64. The interior area enclosed by the reflector, between the peak 64 and the inside or "base" face 62 of the well 60 defines an enclosure in which a conventional fluorescent light ballast 66 is located. The ballast 66 can be attached to the base face 62 by screws, clips or other acceptable fasteners. Typically, the reflector 44 is secured to the housing by clips or a pressure/friction fit that relies, in part, upon flexure of the reflector to maintain it pressurably against the walls of the housing. The overhang 40, or another end recess, can act, in part, to retain the reflector against the upper surface of the housing 20. Additional lips can be provided around the housing to further maintain the reflector in place. As described further below, the reflector is flexible according to a preferred embodiment. This flexibility aids in attachment and removal of the reflector by allowing it to be elastically bent over a supporting structure.

Figure 3:
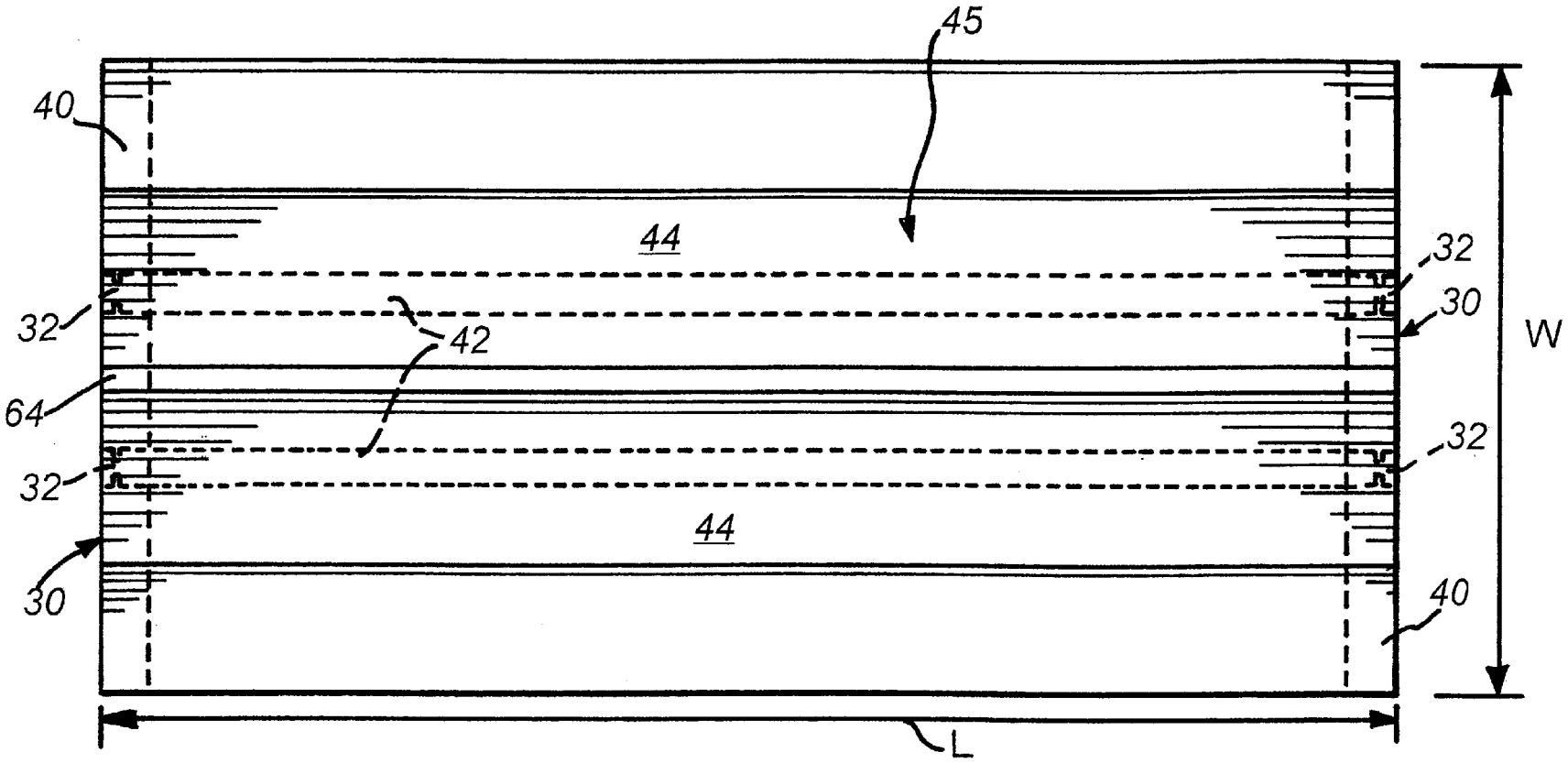
FIG. 3 is a plan view of the light fixture of FIG. 1.
Figure 4:
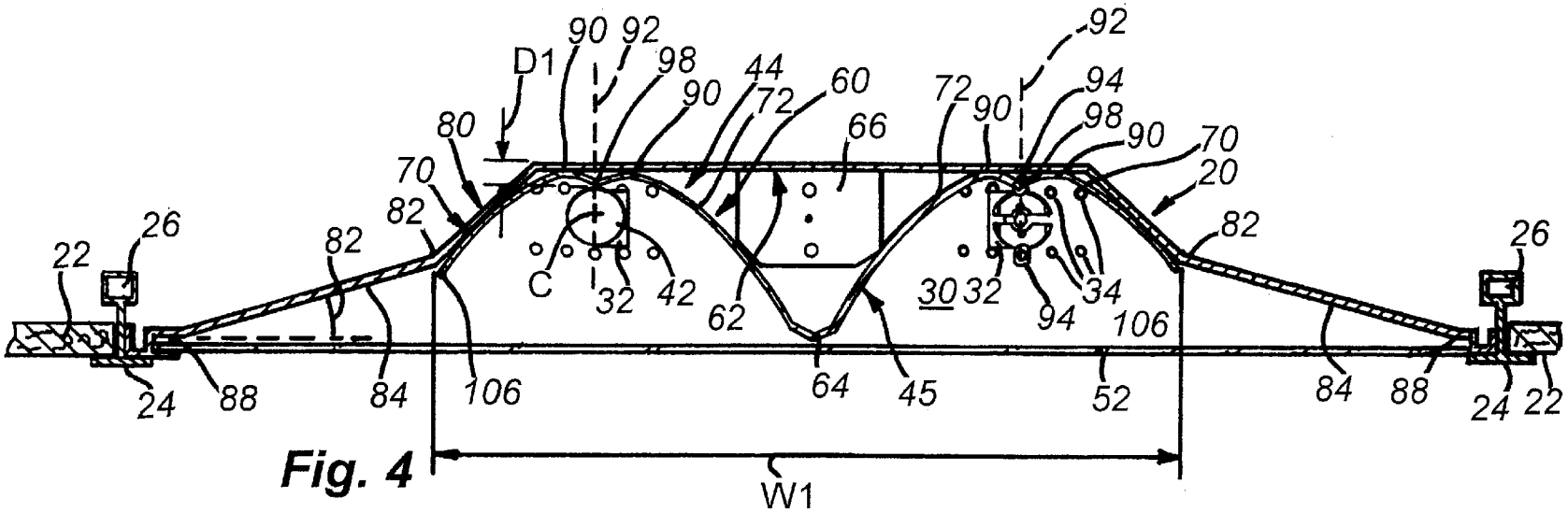
FIG. 4 is a side cross-section of the light fixture of FIG. 1.

The layout of the fixture, including the reflector 44 and bulbs 42 is shown in further detail in plan view in FIG. 3 and in side view in FIG. 4.

With further reference to FIG. 4, the cross-sectional profile of the reflectors 44 of the reflector structure 45 is shown in detail. The reflector structure 45 can comprise an integral unit formed from a single sheet of material. Alternatively, discrete reflectors 44 can be provided, and be joined at the peak 64 or at another location. Each reflector 44 comprises, in essence, a pair of semi-trough-shaped sections 70 and 72. In other words, each section forms an individual trough, as shown and described below, The inner sections 72 of each reflector 44 are joined at the peak and extend almost the entire depth D of the well 60. The opposing outer sections 70 are located remote from each other and extend approximately one-half of the depth D of the well 60.

The well 60, itself, has an approximate width W1 of 13 inches. The side walls 80 of the well 60 extend from the base face 62 at an angle of approximately 135°. The side walls 80 terminate at a pair of comers 82. Thenceforth, the outer housing walls 84 assume a shallower angle out to the widthwise ends 88 of the housing 20. The outer walls 84 extend at an angle A 15° relative to the horizontal plane (e.g., the plane defined by the grate 52) of the fixture.

Each of the sections 70 and 72 of each respective reflector 44 define a maximum trough-bottom 90 remote from the center line 92 of the bulb. The center line 92 of the bulb, in this embodiment, is located in the center set of mounting holes 34. Note that movable pins 94 are provided on each connector/bracket 32 to enable the connector/bracket 32 to be seated in the appropriate set of mounting holes 34. These pins can be spring loaded and can include a variety of securing structures such as hooks or detents.

The maximum trough-bottom 90 of each section 70 and 72 is, as stated, remote from the center line 92 of the bulb. At the center line of the bulb 92, each section 70, 72 joins at a local peak 98. The local peak is approximately located along the center line 92. The local peak 98 extends downwardly from the base face 62 almost into contact with the surface of the bulb 42. The extension of the local peak 98 from the base face 62 is a distance D1 equal to approximately 3/16 inches, in a preferred embodiment. In this embodiment, the center C of the bulb is located a distance of approximately ¾ inch from the base face 62.

Figure 5:
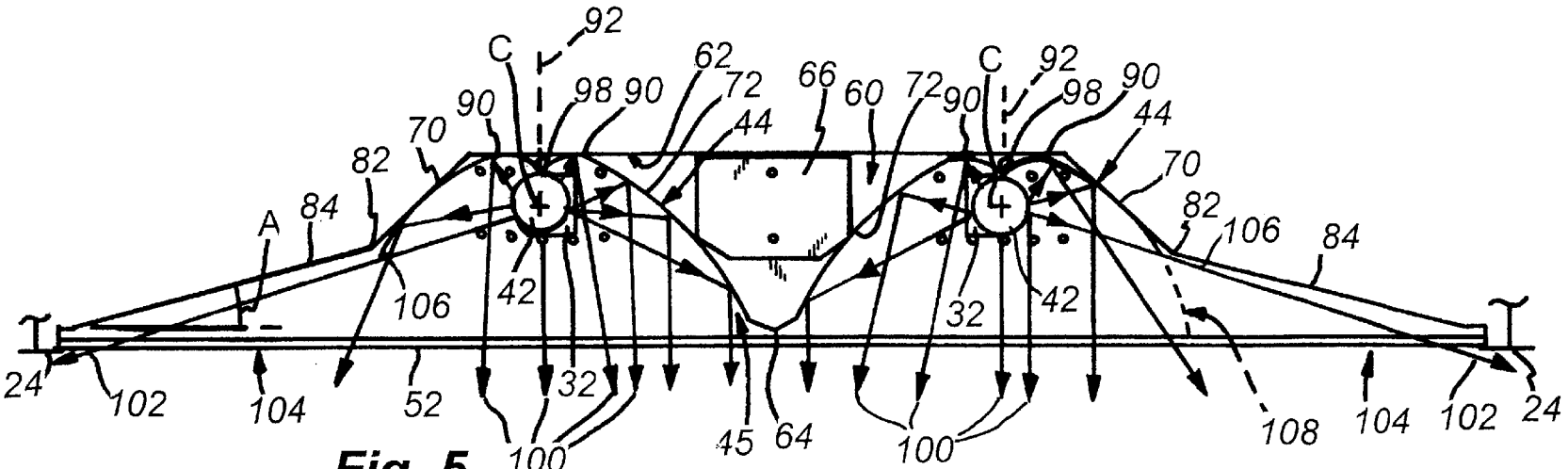
FIG. 5 is a somewhat schematic side cross-section of the light fixture of FIG. 1 detailing the reflection path of light from each of the bulbs.

With reference to FIG. 5, the optical function of the housing and reflector shape is described in more detail. Each reflector 44 is arranged to reflect incident light rays transmitted from the bulb surface so that these rays become reflected and transmitted rays 100 that are directed downwardly as shown. If a single trough bottom were located on the center line, a large portion of light would be reflected back into the bulb itself. The reflector sections 70, 72 of this invention each have remote trough bottoms 90 that together form local peak 98 so that substantially all rays exiting the surface of the bulb 42 are reflected away from the bulb surface, and downwardly toward the outlet of the fixture. In other words, the local peak 98 and remote maximum troughs 90 prevent substantially all rays from being reflected back through the body of the bulb 42. As noted above, reflection of rays back through the body of the bulb substantially reduces there intensity and results in lesser efficient transmission of light from the bulb.

The location of the housing corner 82, and the angle A of the outer housing walls 84, is chosen so that a portion of the rays 102 are transmitted directly to the outlying widthwise ends of the housing. The majority of transmitted light is provided beneath the main well 60 of the fixture. In an alternate embodiment, it is contemplated that the overall width of the fixture is approximately equal to the width of the well 60. The reflection of light is sufficiently efficient using two bulbs that the equivalent light of three or four bulbs in a normal width fixture can be obtained. (Experimentally, efficiencies in excess of 90% have been achieved according to this invention). Nevertheless, conventional fixtures have a width overall of two feet. To match the existing width, the outer wall 84 are included. A smaller portion of the overall transmitted light is delivered to the outer wings or "ends" 104 of the fixture opening. By using a grate 52 that is translucent, and that includes a diffuser structure, such as a series of conventional pyramidal shapes, the fixture gives the overall appearance of being completely lit. In actuality, the portion of the fixture beneath the central well 60 is lit to a greater extent than the outlying ends 104. Nevertheless, a sufficient quantity of light is present at the outlying ends such that, in combination with the diffuser grate 52, the fixture appears to be illuminated overall. Note that the main peak 64 between reflectors 44 extends substantially to the grate 52, thus getting one reflector well from another. Conversely, the outer reflector sections 70 each extend downwardly to a higher end point (line) 106 that enables the light rays 102 to be directed to the outer ends 104 of the fixture. In an alternate embodiment the outer edge of the reflector can be extended as shown by the phantom line 108. In such an embodiment, the outer ends 104 can be omitted, resulting in a substantially narrower fixture. In general, the reflector structure according to this embodiment enables a substantially smaller overall height H for the housing between the base face 62 and the opening (at the grate 52). In this embodiment, the height H is approximately 2⅞ inches.

Figure 6:
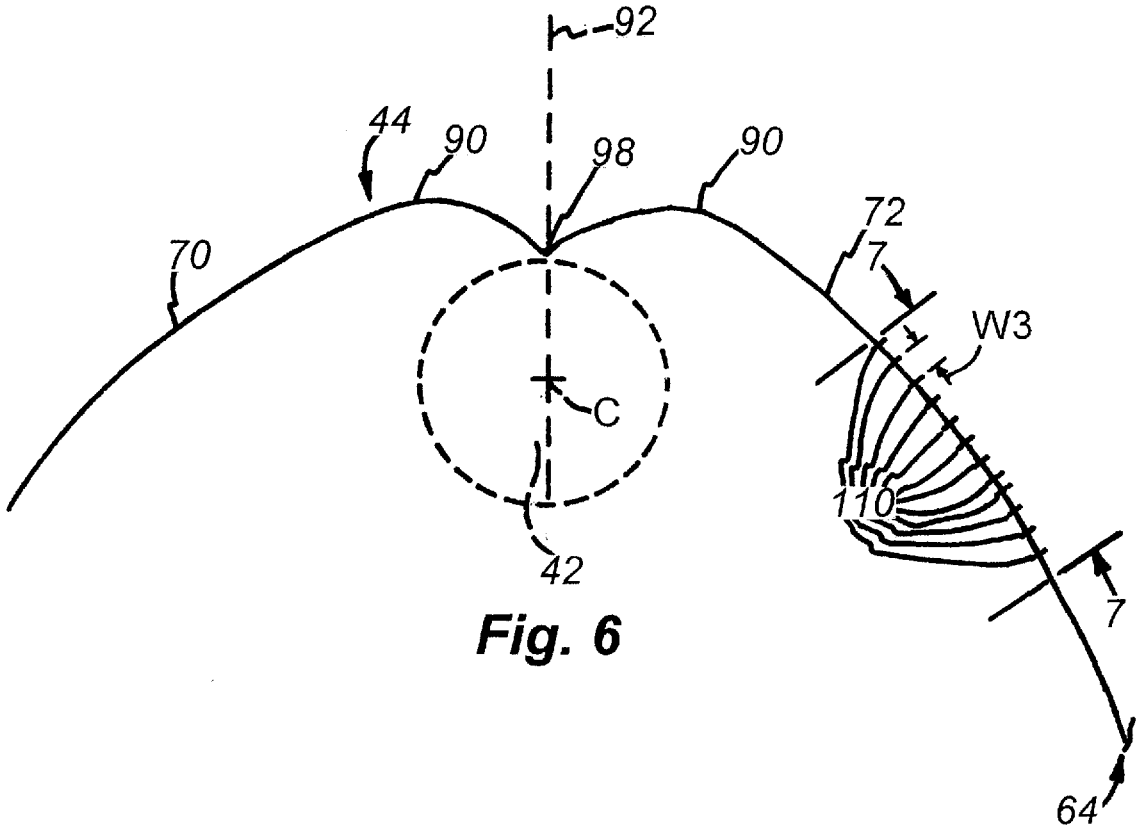
FIG. 6 is a more-detailed schematic side cross-section of a portion of the reflector and bulb of the light fixture of FIG. 1.
Figure 7:
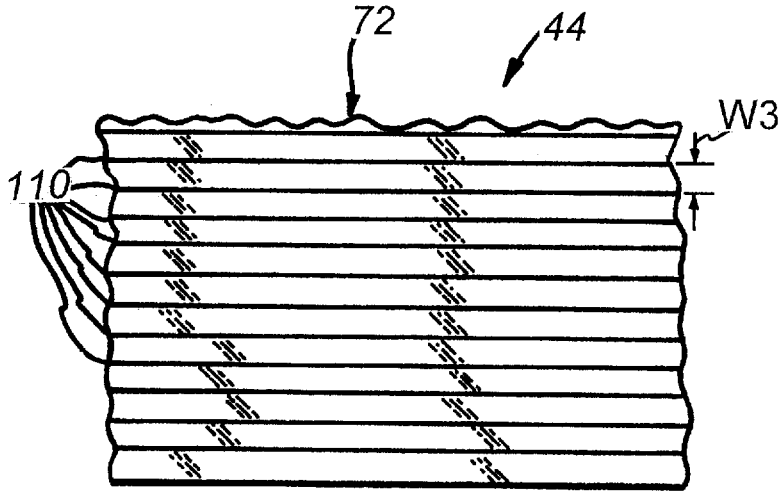
FIG. 7 is a plan view of a portion of the reflector surface taking along line 7—7 of FIG. 6.

FIG. 6 further details the surface structure of an exemplary reflector 44 according to this invention. In one embodiment, the reflector comprises a series of individual facets that are, themselves, substantially plainer having a width W3 that extends substantially the length of the reflector. As detailed in FIG. 6, the facets are each defined by the exemplary dividing lines 110. Each facet is exposed at a discrete angle relative to adjacent facets so that the overall shape defines the semi-parabolic curve displayed by sections 70 and 72. As used herein, the term "double-trough" reflector shall refer to a reflector having a shape with two troughs joined at a low local peak therebetween in which the bulb is adjacent to the local peak, and incident light transmitted from the bulb to the reflector, from substantially any point along the bulb, is reflected away from the bulb and toward the opening of the fixture beneath the bulb. The exact curve of the shape can be derived through any number of methods. It need not follow strict a mathematical function. In general, the curve of the shape is derived by drawing lines from the bulb to the reflector surface and modifying the reflector surface until all lines are reflected substantially away from the bulb. It is recognized that a reflection of an incident light ray projects from a surface at any equal and opposite angle to the angle in which it strikes the surface. Each point along the reflector (or each facet) is located so that reflections exhibit the above-described characteristic transmission (e.g. a substantial quantity of rays "miss" hitting the bulb surface when reflected from the reflector surface) Geometric construction using the known height of the central well, the central well width and the spacing between bulbs can be used to derive the shape. FIG. 7 illustrates a partial plan view through the cross-section of line 7—7. The parallel arrangement of facets along the reflector is more clearly shown. The lines delineating each facet extend substantially along the entire length of the reflector 44.

A reflector according to this embodiment can be formed in a variety of manners. A form can be made from sufficiently hard material and a reflector can be stamped so that it follows the contours of the form. Alternatively, a mold can be made with a series of facets and an injection molded polymer part can be produced. A reflector can also be machined to include a faceted surface as shown or a series of individual strips can be adhered to each other appropriating polishing and/or application of reflective coatings can also be performed to produce the desired specular surface.

In one embodiment, the reflector comprises a thin flexible material such as thin reflective plastic, Mylar® or thin-gauged flexible metal. The reflector is sufficiently flexible so that the local peaks 98 can be moved toward and away from each other by flexure of the reflector structure 45 about the main peak 64. Likewise, the trough sides of the reflector sections 70 and 72 can be moved closer to, or further from, each other to widen or narrow the overall reflector trough. By moving the bulbs 42 toward and away from each other using the adjustable brackets 32 and holes 34, the geometry of the reflector structure 45 as a whole can be changed. For example, if the bulbs are moved further apart, each local peak 98 can be moved further from the other causing the shape of the overall reflector structure 45 to flatten. This can be used to change the optical characteristics of the fixture, causing a less concentrated light or, alternatively, a more concentrated light to be transmitted upon demand. Likewise, the bulb can be moved without changing the location of the local peaks 98 relative to each other causing a different reflection characteristic. In general, movement of the local peaks 98 toward each other within the same width well 60 would cause the section 72 to become more vertical, while the section 70 may become more horizontal. Conversely, movement of the local peaks 98 away from each other would cause the reflector sections 70 to become more vertical, while the sections 72 would become more horizontal. The concentration of light can, thus, be varied depending upon the particular application of the fixture. This is particularly desirable when a fixture is located higher or lower in a space so that the correct spread of light can be obtained. It is also desirable if fixtures are to be located more or less frequently within a given area of space.

The foregoing has been a detailed description of a preferred embodiment of the invention. Various modifications and additions can be made without departing from the spirit and scope and of the invention. For example, it is expressly contemplated that the size of the fixture and/or the number of lamps used can be varied. It is primarily that each lamp be provided with a reflector as shown. The reflector can be extended to provide a deeper well or, alternatively, truncated to be shallower than that described. The surface shape of the reflector can be varied. Facets can be used in one embodiment, or a smooth continuous surface can be substituted. Other forms of surface irregularities and discontinuities can be provided to the reflector according to alternate embodiments. In addition, while a flush-mounted fixture is shown a surface mount fixture that projects from a fixed ceiling can also be provided. An appropriate housing that encloses the entire surface-mount fixture can be used. For example, a narrower housing can be used that omits the outer sides of the housing and encloses only the main well of the housing inner surface-mount configuration. Likewise, the ballast can be located in a variety of positions other than that shown. Finally, the grate used to cover the fixture can be omitted or modified to have a different surface shape than that shown and described. Accordingly, this description is meant to be taken only by way of example and not to otherwise limit the scope of the invention.

What is claimed is:

1. A fluorescent light fixture comprising:

a housing defining a main well having a lengthwise direction and a widthwise direction;

at least two fluorescent bulbs extending in the lengthwise direction between a pair of mounting brackets located adjacent side panels that extend in the widthwise direction;

a specular reflector defining a pair of parallel double-trough reflector shapes, each of the shapes with a local peak extending toward a respective one of the bulbs and a pair of remote maximum trough bottoms extending away from the respective one of the bulbs adjacent the local peak and on each of opposing sides of the local peak and each of the double-trough reflector shapes having trough walls that extend further away from the maximum trough bottoms and around the respective one of the bulbs and that extend in a widthwise direction away from the respective one of the bulbs outwardly from each other, the reflector including a main central peak between each of the two bulbs that isolates each of the two bulbs optically from each other;

wherein each of the double-trough reflector shapes is constructed and arranged so that substantially all light exiting from the surface of the respective one of the bulbs is reflected away from the respective one of the bulbs and outwardly through and opening in the housing; and a pair of sloped outer sides that extend in the widthwise direction away from the reflector, the sloped outer sides having wall sections that are positioned at an angle so that light transmitted directly from each of the bulbs is directed free of obstruction to outermost widthwise edges of the fixture, and the fixture including a diffuser grate located over substantially the entire opening of the fixture.

2. The fixture as set forth in claim 1 wherein the outermost widthwise edges of the fixture are located adjacent a corner defined between the walls of the outer sides of the housing and wherein the widthwise ends of the reflectors being more remote from the grate than the central peak.

3. The fixture as set forth in claim 1 wherein the housing and the reflector, adjacent the central peak, defines a cavity and wherein a ballast is located in the cavity.

4. The fixture as set forth in claim 1 further comprising adjustable brackets for mounting each of the bulbs, including a plurality of mounting locations arranged in a widthwise direction along the housing whereby the location of the bulbs with respect to the housing and to the reflector is variable.

5. The fixture as set forth in claim 4 wherein the reflector is flexible and is constructed and arranged to flex into a predetermined orientation in response to an applied pressure thereto, whereby the local peaks can be moved to remain adjacent to each respective bulb as the adjustable brackets are moved in the widthwise direction.

6. The fixture as set forth in claim 1 wherein the housing further defines an outline taken through a cross section in the widthwise direction having a central cavity with a first depth, the reflector being seated in a base of the cavity, opposite an opening in the cavity, and a pair of sloped side walls extending from points on the central cavity remote from and suspended above the base and sloping outwardly from the central cavity toward outermost widthwise edges of the housing, the reflector having outer widthwise edges that are located approximately at the points.

7. The fixture as set forth in claim 1 wherein at least a portion of the reflector includes a surface that comprises a plurality of surface segments that are each planar and are joined to each other and thereby define a segmented continuous trough surface.

* * * * *